US010260335B2

(12) United States Patent
Chia et al.

(10) Patent No.: US 10,260,335 B2
(45) Date of Patent: Apr. 16, 2019

(54) OPTO-ELECTRICAL NETWORKS FOR CONTROLLING DOWNHOLE ELECTRONIC DEVICES

(71) Applicant: HALLIBURTON ENERGY SERVICES, INC., Houston, TX (US)

(72) Inventors: Yan-Wah Michael Chia, Singapore (SG); Glenn Andrew Wilson, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/107,737

(22) PCT Filed: Oct. 30, 2014

(86) PCT No.: PCT/US2014/063109
§ 371 (c)(1),
(2) Date: Jun. 23, 2016

(87) PCT Pub. No.: WO2016/068931
PCT Pub. Date: May 6, 2016

(65) Prior Publication Data

US 2016/0319658 A1 Nov. 3, 2016

(51) Int. Cl.
*E21B 47/12* (2012.01)
*E21B 47/00* (2012.01)
*E21B 49/00* (2006.01)

(52) U.S. Cl.
CPC ..... *E21B 47/123* (2013.01); *E21B 47/00* (2013.01); *E21B 49/00* (2013.01)

(58) Field of Classification Search
CPC ..... E21B 17/20; E21B 17/206; E21B 19/008; E21B 28/00; E21B 43/003; E21B 47/065;
(Continued)

(56) References Cited

U.S. PATENT DOCUMENTS 5,642,051 A 6/1997 Babour et al.
6,374,913 B1 4/2002 Robbins et al.
(Continued)

FOREIGN PATENT DOCUMENTS

WO 2015178906 11/2015

OTHER PUBLICATIONS

Bergmann et al., Surface-downhole electrical resistivity tomography applied to monitoring of CO2 storage at Ketzin, Germany, Sep. 2012, 16 pages.

(Continued)

*Primary Examiner* — Muhammad N Edun
*Assistant Examiner* — Jerold B Murphy
(74) *Attorney, Agent, or Firm* — Kilpatrick Townsend & Stockton LLP

(57) ABSTRACT

Systems and methods are provided for using opto-electrical networks to control downhole electronic devices. A system is provided that can include an optical transmitter. The optical transmitter can generate a first electrical signal associated with a radio frequency or a frequency bandwidth of the radio frequency. The optical transmitter can also convert the first electrical signal to an optical signal. The optical transmitter can further transmit the optical signal over a fiber-optic cable to an optical receiver deployed in a wellbore. The system can include the optical receiver. The optical receiver can convert the optical signal to a second electrical signal associated with the radio frequency or the frequency bandwidth. The optical receiver can also control an electronic device in the wellbore that is identified from the radio frequency or the frequency bandwidth of the second electrical signal.

21 Claims, 10 Drawing Sheets

(58) Field of Classification Search
CPC ..... E21B 47/10; E21B 47/122; E21B 47/123; E21B 47/14; E21B 47/16
See application file for complete search history.

(56) References Cited

U.S. PATENT DOCUMENTS

| | | | | |
|---|---|---|---|---|
| 6,531,694 | B2 | 3/2003 | Johnson et al. | |
| 6,534,986 | B2 | 3/2003 | Nichols et al. | |
| 6,750,440 | B1 * | 6/2004 | Leggett | E21B 41/0085 250/221 |
| 7,140,435 | B2 | 11/2006 | Defretin et al. | |
| 7,321,735 | B1 * | 1/2008 | Smith | H03D 7/00 398/202 |
| 7,573,891 | B1 * | 8/2009 | Chow | H04B 3/542 370/401 |
| 7,617,873 | B2 | 11/2009 | Lovell et al. | |
| 7,673,682 | B2 | 3/2010 | Daily | |
| 7,954,560 | B2 | 6/2011 | Mathiszik et al. | |
| 8,649,684 | B2 * | 2/2014 | Casterline | H04B 10/25754 398/115 |
| 2003/0038634 | A1 | 2/2003 | Strack et al. | |
| 2006/0022469 | A1 | 2/2006 | Syed et al. | |
| 2008/0272932 | A1 * | 11/2008 | Booker | H04B 3/54 340/854.9 |
| 2010/0013663 | A1 | 1/2010 | Cavender et al. | |
| 2010/0155059 | A1 * | 6/2010 | Ullah | E21B 17/206 166/254.2 |
| 2010/0271030 | A1 | 10/2010 | Reiderman et al. | |
| 2011/0083838 | A1 | 4/2011 | LaBrecque et al. | |
| 2011/0139447 | A1 | 6/2011 | Ramos et al. | |
| 2012/0223717 | A1 | 9/2012 | LaBrecque et al. | |
| 2012/0293179 | A1 | 11/2012 | Colombo et al. | |
| 2013/0110402 | A1 * | 5/2013 | Godager | E21B 47/122 702/7 |
| 2013/0168081 | A1 | 7/2013 | Yang et al. | |
| 2014/0008968 | A1 | 1/2014 | Moeny et al. | |
| 2014/0139350 | A1 | 5/2014 | Cook, II et al. | |
| 2014/0216816 | A1 | 8/2014 | Lehr et al. | |
| 2014/0270789 | A1 * | 9/2014 | Coffey | H04B 10/807 398/116 |
| 2015/0045968 | A1 * | 2/2015 | Xia | G05D 23/1905 700/278 |

OTHER PUBLICATIONS

Carrigan et al., Electrical resistance tomographic monitoring of CO2 movement in deep geologic reservoirs, Oct. 2013, 9 pages.

Kiessling et al., Geoelectrical methods for monitoring geological CO2 storage: First results from cross-hole and surface-downhole measurements from the CO2SINK test site at Ketzin (Germany), Sep. 2010, 12 pages.

International Patent Application No. PCT/US2014/063109, International Search Report and Written Opinion, dated Jul. 15, 2015, 16 pages.

Tondel et al., Remote reservoir monitoring in oil sands: From feasibility study to baseline datasets, May 6-12, 2013, 5 pages.

Tondel et al., Reservoir monitoring in oil sands: Developing a permanent cross-well system, Abstract, 2011, 1 page.

* cited by examiner

OPTO-ELECTRICAL NETWORKS FOR CONTROLLING DOWNHOLE ELECTRONIC DEVICES

CROSS-REFERENCE TO RELATED APPLICATIONS

This is a U.S. national phase under 35 U.S.C. 371 of International Patent Application No. PCT/US2014/063109, titled "Opto-Electrical Networks for Controlling Downhole Electronic Devices" and filed Oct. 30, 2014, the entirety of which is incorporated herein by reference.

TECHNICAL FIELD

The present disclosure relates generally to devices for use in well systems. More specifically, but not by way of limitation, this disclosure relates to opto-electrical networks for controlling downhole electronic devices.

BACKGROUND

A well system (e.g., an oil or gas well for extracting fluids or gas from a subterranean formation) can include various electronic devices in a wellbore. For example, the well system can include a pressure sensor for detecting the pressure in the wellbore. Such sensors may be part of an intelligent completion. The well system may include advanced sensor systems such as electromagnetic (EM) reservoir monitoring systems that consist of multiple electronic devices. In many cases, the electronic devices can be positioned far from the well surface. For example, some electronic devices can be positioned more than 20,000 feet from the well surface. Controlling electronic devices at such far distances using traditional power line systems can present challenges. For example, high-frequency electrical signals, such as those transmitted over copper cables in power line systems, can significantly attenuate over large distances. These electrical signals can further degrade in the presence of the high temperatures commonly found in wellbores.

DETAILED DESCRIPTION

Figure 1:
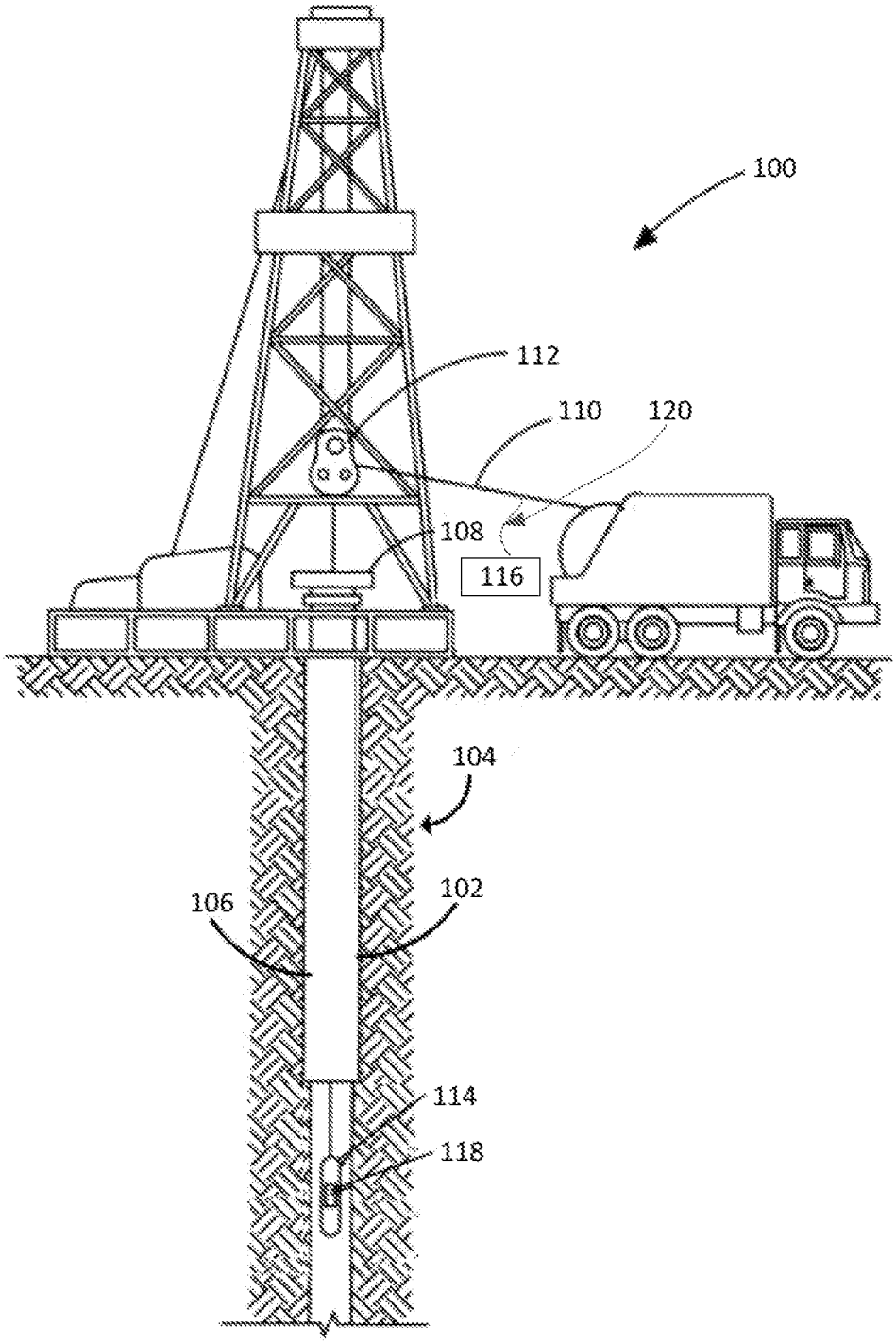
FIG. 1 is a cross-sectional view of an example of a well system that includes a system for controlling downhole electronic devices using opto-electrical networks according to one example.

Certain aspects and features of the present disclosure are directed to controlling downhole electronic devices using opto-electrical networks. The opto-electrical network can include an optical transmitter and optical receiver that can be positioned in a wellbore. The opto-electrical network can be used to communicate signals for controlling electronic devices in the wellbore. For example, the optical transmitter can generate an optical signal that includes information for controlling one or more electronic devices in the wellbore. The optical transmitter can transmit the optical signal to the optical receiver over an optical cable (e.g., a fiber-optic cable). The optical receiver can be electrically coupled to the electronic devices. The optical receiver can control the electronic devices based on the information included in the optical signal.

The opto-electrical network can be used to simultaneously or sequentially control multiple electronic devices in the wellbore. In some aspects, each electronic device can be assigned a respective frequency bandwidth. The frequency bandwidth can include one or more frequencies (e.g., radio frequencies). For example, one electronic device can be assigned the bandwidth from 2 GHz to 3 GHz. For N electronic devices, N different frequency bandwidths can be used. To operate an electronic device, the transmitter can generate an electrical signal with a frequency that is within the bandwidth assigned to that electrical device. The transmitter can convert the electrical signal to an optical signal. The transmitter can transmit the optical signal via an optical cable (e.g., a fiber-optic cable) to the receiver. The receiver can convert the optical signal into an electrical signal. The receiver can operate an actuator (e.g., a switch) based on the frequency of the electrical signal. The actuator can operate one or more associated electronic devices.

In some aspects, the transmitter can transmit different kinds of instructions to the receiver for controlling a particular electronic device. Each kind of instruction can be associated with a frequency (or sub-frequency-band) within the frequency band assigned to the electronic device. For example, if the electronic device has a bandwidth between 2 GHz and 3 GHz, the transmitter can transmit an instruction to turn the electronic device on or off using a signal having a frequency of 2.2 GHz. The transmitter can transmit a "detect vibrations" instruction (e.g., an instruction for the electronic device to detect acoustic vibrations in the wellbore) at frequencies between 2.4 GHz and 2.6 GHz. The transmitter can transmit a "detect strain" instruction (e.g., an instruction for the electronic device to detect the strain on a well component in the wellbore) at a frequency of 2.8 GHz. In this manner, the transmitter can transmit multiple different kinds of instructions to the receiver for controlling a particular electronic device.

In some aspects, each electronic device can be assigned a digital identifier. To operate an electronic device, the transmitter can generate digital signal including the digital identifier. The digital signal can include one or more instructions for controlling the electronic device. The transmitter can convert the digital signal to an optical signal and transmit the optical signal to the receiver. The receiver can convert the optical signal back into the digital signal. The receiver can operate one or more electronic devices associated with the digital identifier. The receiver can operate the electronic devices based on the instructions included within the digital signal.

In some aspects, opto-electrical networks can be used to control electronic devices that are positioned at substantial distances from the transmitter (e.g., at the surface of the wellbore). Optical signals can be used to control electronic devices at substantial differences because these optical signals can propagate over large distances with minimal attenuation. For example, an opto-electrical network can control electronic devices that are more than 20,000 feet away from the transmitter. Conversely, with power line systems, high-frequency electrical signals can significantly attenuate over large distances. These electrical signals can attenuate even further in the presence of the high temperatures commonly found in wellbores. This can render power line systems inadequate for transmitting high-frequency control signals to electronic devices in a wellbore. Additionally, opto-electrical networks can also use less power than power line systems and be more temperature-independent than power line systems.

In some aspects, using opto-electrical networks can minimize or otherwise reduce the number of cables positioned in the wellbore for operating downhole devices. For example, the transmitter can be coupled to the receiver via a single optical cable positioned within a casing in the wellbore. Conversely, power line systems can require a substantial number of cables to be positioned in the wellbore for transmitting instructions to electronic devices. Reducing the number of cables in a transmission network by using an opto-electrical network can reduce the likelihood that a cable will be damaged during the course of well operations. Reducing the number of cables in a transmission network by using an opto-electrical network can also simply the process of installing the transmission network in a well system.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100 that includes a system for controlling downhole electronic devices 114 using opto-electrical networks. Although depicted in this example as a land-based well system, the well system 100 can be offshore.

The well system 100 includes a wellbore 102 extending through various earth strata. The wellbore 102 extends through a hydrocarbon bearing subterranean formation 104. A casing string 106 extends from the well surface 108 into the subterranean formation 104. The casing string 106 can provide a conduit via which formation fluids, such as production fluids produced from the subterranean formation 104, can travel from the wellbore 102 to the well surface 108.

The well system 100 can also include at least one electronic device 114. Examples of the electronic device 114 can include a well tool (e.g., a formation testing tool, a logging while drilling tool, a reservoir monitoring tool), a fluid/cement monitoring tool, a multi-phase flow monitoring system, an antenna, an electrode, a valve, a gauge, a sensor (e.g., a sensor for detecting pressure, strain, temperature, fluid density, fluid viscosity, acoustic vibrations, a chemical, a potential, an electric field, or a magnetic field), another optical device or system, an electric dipole antenna, a magnetic dipole antenna, a multi-turn loop antenna, multiple mutually orthogonal antennas, etc. In some aspects, the electronic device 114 can be coupled to a wireline 110 and deployed in the wellbore 102, for example, using a winch 112, as depicted in FIG. 1. In additional or alternative aspects, the electronic device 114 can be deployed using slickline, coiled tubing, or other suitable mechanisms.

The well system 100 can include a transmitter 116. In some aspects, the transmitter 116 can be positioned at the well surface 108, as depicted in FIG. 1. In additional or alternative aspects, the transmitter 116 can be positioned at other locations (e.g., below ground, at a remote location, etc.). The transmitter 116 can be coupled to a receiver 118 via an optical cable 120. In the example depicted in FIG. 1, the optical cable 120 is integrated with the wireline 110. In additional or alternative aspects, the optical cable 120 can be deployed separately from the wireline 110. The transmitter 116 can be configured to transmit optical signals to the receiver 118 via the optical cable 120 or other optical transmission cable.

The well system 100 can include a receiver 118. The receiver 118 can be positioned in the wellbore 102. The receiver 118 can be electrically coupled to one or more electronic devices 114 positioned in the wellbore 102. The receiver 118 can receive optical signals from the transmitter 116 and, based on the optical signals, operate the electronic devices 114 (e.g., turn on or off an electronic device 114, cause the electronic device 114 perform a function, etc.). In some aspects, optical signals can travel longer distances with less attenuation than regular electrical signals (e.g., signals transmitted via copper wire). This can allow for more precise controlling of downhole electronic devices 114, which can be positioned at significant distances from the well surface 108 or the transmitter 116.

Figure 2:
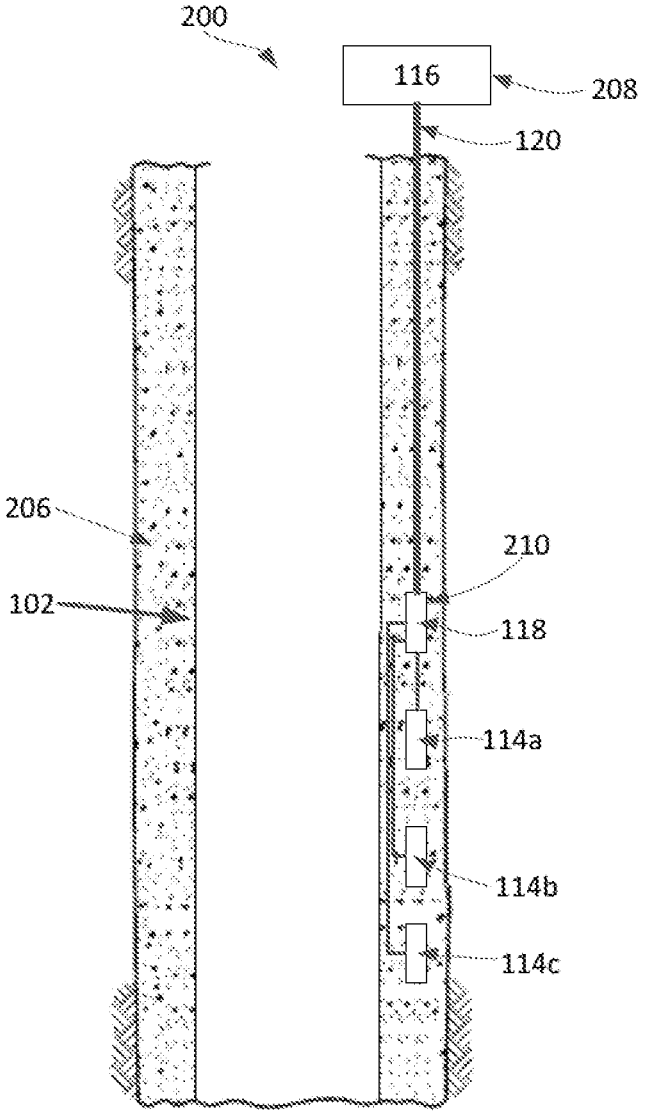
FIG. 2 is a cross-sectional view of another example of a well system that includes a system for controlling downhole electronic devices using opto-electrical networks according to one example.

FIG. 2 is a cross-sectional view of another example of a well system 200 that includes a system for controlling downhole electronic devices 114*a*, 114*b*, 114*c* using opto-electrical networks according to one example. The well system 200 includes a wellbore 102 drilled from a subterranean formation. The wellbore 102 can be cased and cemented 206. The well system 200 can also include other well components (not shown for clarity), such as one or more valves, a tubular string, a wireline, a slickline, a coiled tube, a bottom hole assembly, or a logging tool.

The well system 200 can include a transmitter 116. The transmitter 116 can be coupled to a receiver 118 via an optical cable 120 or other optical transmission cable. The receiver 118 can be permanently positioned in the wellbore 102. In this example, the receiver 118 is positioned within the cement sheath 206 lining the wellbore 102. The optical cable 120 can run through the cement sheath 206. The receiver 118 can be electrically coupled to one or more electronic devices 114*a*, 114*b*, 114*c*. The electronic devices 114*a*, 114*b*, 114*c* can be permanently positioned in the wellbore 102. The transmitter 116 can transmit one or more optical signals via the optical cable 120 to the receiver, which can responsively operate the electronic devices 114*a*, 114*b*, 114*c*.

In some aspects, the transmitter 116 can include a housing 208. The receiver 118 can also include a housing 210. The housings 208, 210 can be configured to withstand downhole environmental conditions. For example, the housings 208, 210 can be configured to withstand more than 30,000 psi of pressure and temperatures over 300° C. The housings 208, 210 can allow the transmitter 116 and receiver 118 to work in a range of well systems 200, including steam injection well systems.

Figure 3:
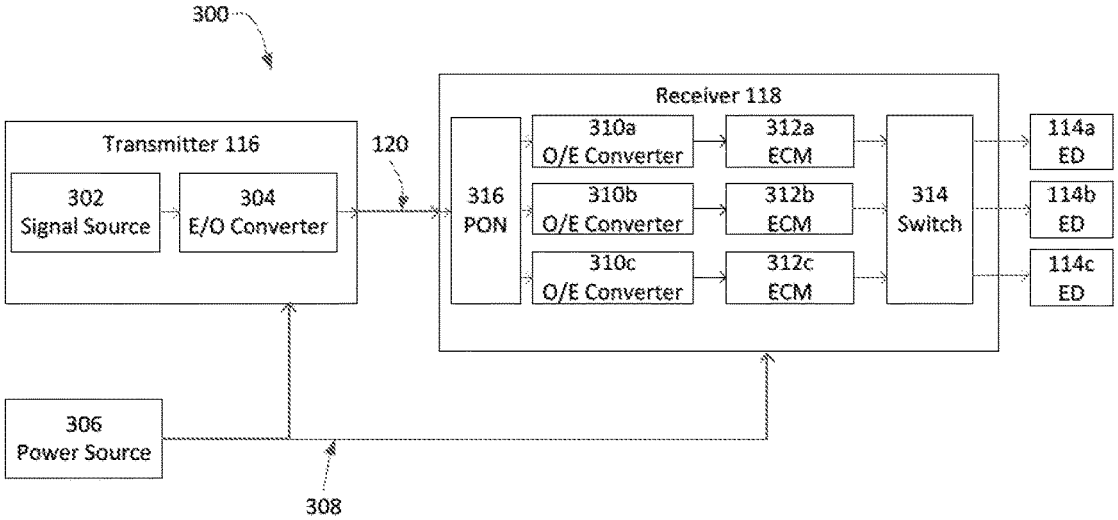
FIG. 3 is a block diagram showing an example of an opto-electrical network for controlling downhole electronic devices according to one example.

FIG. 3 is a block diagram showing an example of an opto-electrical network 300 for controlling downhole electronic devices 114*a*, 114*b*, 114*c* (abbreviated "ED" in FIG. 3) according to one example. As described above, the opto-electrical network 300 can include a transmitter 116 electrically coupled to a receiver 118 via an optical cable 120.

The transmitter 116 can include a signal source 302. Examples of the signal source 302 can include a computing device, processor, microcontroller, crystal, oscillator, comb generator, or other device for generating a signal with a predetermined frequency. In some aspects, the signal source 302 can include a phase locked loop for producing a signal with a stable frequency. The signal source 302 can be electrically coupled to an electrical-to-optical (E/O) converter 304. The E/O converter 304 can be configured to receive an electrical signal and convert it to an optical signal for transmission through the optical cable 120. The E/O converter 304 can include, for example, a light emitting diode (LED) or a laser source.

The receiver 118 can receive an optical signal from the transmitter 116. The receiver 118 can include a passive optical network 316 (abbreviated "PON" in FIG. 3). The passive optical network 316 can split the received optical signal among two or more optical-to-electrical (O/E) converters 310*a*, 310*b*, 310*c*. The O/E converters 310*a*, 310*b*, 310*c* can be configured to receive an optical signal and convert it to an electrical signal for use by other receiver 118 components. Each of the O/E converters 310*a*, 310*b*, 310*c* can include a photodiode. The O/E converters 310*a*, 310*b*, 310*c* can be coupled to respective electronic control modules 312*a*, 312*b*, 312*c* (abbreviated "ECM" in FIG. 3). Each of the electronic control modules 312*a*, 312*b*, 312*c* can be configured to receive an electrical signal from a respective one of the O/E converters 310*a*, 310*b*, 310*c* and output a corresponding control signal to a switching circuit 314. The electronic control modules 312*a*, 312*b*, 312*c* can include microcontrollers, diodes, comparators, filters (e.g., high-pass, band-pass, band-stop, or low-pass), or any other component or device for outputting a control signal based on an input signal. Examples of the electronic control modules 312*a*, 312*b*, 312*c* are described in further detail with respect to FIG. 5.

The electronic control modules 312*a*, 312*b*, 312*c* can be electrically coupled to the switching circuit 314. The switching circuit 314 can be, or can include, an actuator. The switching circuit 314 can be configured to receive a control signal (e.g., from the electronic control modules 312*a*, 312*b*, 312*c*). Based on the control signal, the switching circuit 314 can control power to or otherwise operate one or more electronic devices 114*a*, 114*b*, 114*c*. For example, the switching circuit 314 can allow power to flow from the power source 306 to an electronic device 114*a*. The switching circuit 314 can include a multiplexer, relay, or an integrated circuit (IC) switch. Although in the example shown in FIG. 3 the switching circuit 314 is a single component, in other aspects, each of the electronic control modules 312*a*, 312*b*, 312*c* can be coupled to a separate switching circuit 314.

The opto-electrical network 300 can include a power source 306. In some aspects, the power source 306 can be electrically coupled via a power line 308 to the transmitter 116 for supplying power to one or more components of the transmitter 116 (e.g., the signal source 302 and the E/O converter 304). The power can include a low-frequency AC power signal. The power source 306 can be electrically coupled to the receiver 118 via a power line 308 for transmitting power to one or more components within the receiver 118 (e.g., the O/E converters 310*a*, 310*b*, 310*c*, the electronic control modules 312*a*, 312*b*, 312*c*, and the switching circuit 314). The power line 308 can be separate from the optical cable 120 or integrated with the optical cable 120 into a single cable. For example, the power line 308 can be integrated with the optical cable 120 in a tubing encapsulated cable.

Each of the electronic devices 114*a*, 114*b*, 114*c* can be assigned a frequency bandwidth (B). For example, electronic device 114*a* can be assigned the bandwidth from 900 MHz to 1 GHz. For N electronic devices, N different frequency bandwidths can be used (e.g., three frequency bandwidths for three respective electronic devices 114*a*, 114*b*, 114*c*). The bandwidths can be evenly or unevenly spaced. In some aspects, the N different frequency bandwidths can be between 1 GHz and 11 GHz. In some aspects, a guard frequency band (U) can be included on either side of the assigned frequency bandwidth. For example, if the assigned frequency bandwidth is 900 MHz to 1 GHz, a 50 kHz guard band can be included between 850 MHz and 900 MHz, and a 50 kHz guard band can be included between 1 GHz and 1.05 GHz. Thus, the total bandwidth (B') assigned to an electronic device 114*a*, 114*b*, 114*c* can be: $B'=B+2U$. Including a guard frequency band can help ensure that frequency bandwidths do not have overlapping frequency components that would cause interference between adjacent signals.

To operate a specific one of the electronic devices 114*a*, 114*b*, 114*c*, the signal source 302 can generate an electrical signal with a frequency or frequency bandwidth that is within the bandwidth associated with that electronic device 114*a*, 114*b*, 114*c*. In some aspects, the electrical signal can be a tone having a radio frequency or frequency bandwidth. One or more of the electronic devices 114*a*, 114*b*, 114*c* can be controlled based on the frequency or frequency bandwidth of the tone. In some aspects, the frequency or frequency bandwidth of the tone may be used to control an electronic device without modulating the tone or other electrical signal with additional data. The signal source 302 can transmit the electrical signal to the E/O converter 304. The E/O converter 304 can convert the electrical signal to an optical signal. The transmitter 116 can transmit the optical signal to the receiver 118. The receiver 118 can receive the optical signal and convert it into an electrical signal via the O/E converters 310*a*, 310*b*, 310*c*. The O/E converters 310*a*, 310*b*, 310*c* can transmit the electrical signal to the electronic control modules 312*a*, 312*b*, 312*c*. The electronic control modules 312*a*, 312*b*, 312*c* can apply a filter (e.g., a band-pass filter) to the electrical signal. If the electrical signal includes a frequency that can pass through the filter, the electronic control modules 312*a*, 312*b*, 312*c* can operate the switching circuit 314 to actuate a corresponding one of the electronic devices 114*a*, 114*b*, 114*c*. If the electrical signal does not include a frequency that can pass through the filter, the electronic control modules 312*a*, 312*b*, 312*c* may not actuate the corresponding one of the electronic devices 114*a*, 114*b*, 114*c*.

In some aspects, the transmitter 116 can transmit multiple different kinds of instructions to a specific one of the electronic devices 114*a*, 114*b*, 114*c*. In such an example, the bandwidth assigned to the particular one of the electronic devices 114*a*, 114*b*, 114*c* can be larger than if the transmitter 116 can only transmit an on/off instruction to the particular one of the electronic devices 114*a*, 114*b*, 114*c*. The larger bandwidth can allow each kind of instruction to be associated with a frequency (or sub-frequency-band) within the frequency band. For example, if the electronic device 114*a* has a bandwidth between 900 MHz and 1.1 GHz, the transmitter 116 can transmit an instruction to turn the electronic device 114*a* on or off using a signal having a frequency of 950 MHz. The transmitter 116 can transmit a "detect pressure" instruction (e.g., an instruction to cause the electronic device 114*a* to detect a pressure in the wellbore) to the electronic device 114*a* at a frequency of 1 GHz. The transmitter 116 can transmit a "detect temperature" instruction (e.g., an instruction to cause the electronic device 114*a* to detect a temperature in the wellbore) to the electronic device 114*a* at a frequency of 1.05 GHz. In this manner, the transmitter 116 can transmit multiple different instructions for controlling a specific one of the electronic devices 114*a*, 114*b*, 114*c*.

In some aspects, the transmitter 116 can generate an electrical signal associated with one of the electronic devices 114*a*, 114*b*, 114*c*. The transmitter 116 can apply amplitude, phase, or frequency modulation to the electrical signal for transmitting the different instructions. The transmitter 116 can convert the modulated electrical signal to an optical signal and transmit the optical signal to the receiver 118. The receiver 118 can receive and demodulate the signal to determine the instructions. The receiver 118 can control the associated one of the electronic devices 114*a*, 114*b*, 114*c* in conformity with the instructions.

In some aspects, the opto-electrical network 300 can include multiple transmitters 116 and multiple receivers 118. For example, multiple receivers 118 can be positioned in a wellbore and coupled to the optical cable 120. The spacing between the receivers 118 can be uniform or non-uniform. The transmitter 116 can transmit an optical signal to the receivers 118, which can control one or more associated electronic devices 114*a*, 114*b*, 114*c*.

Figure 4:
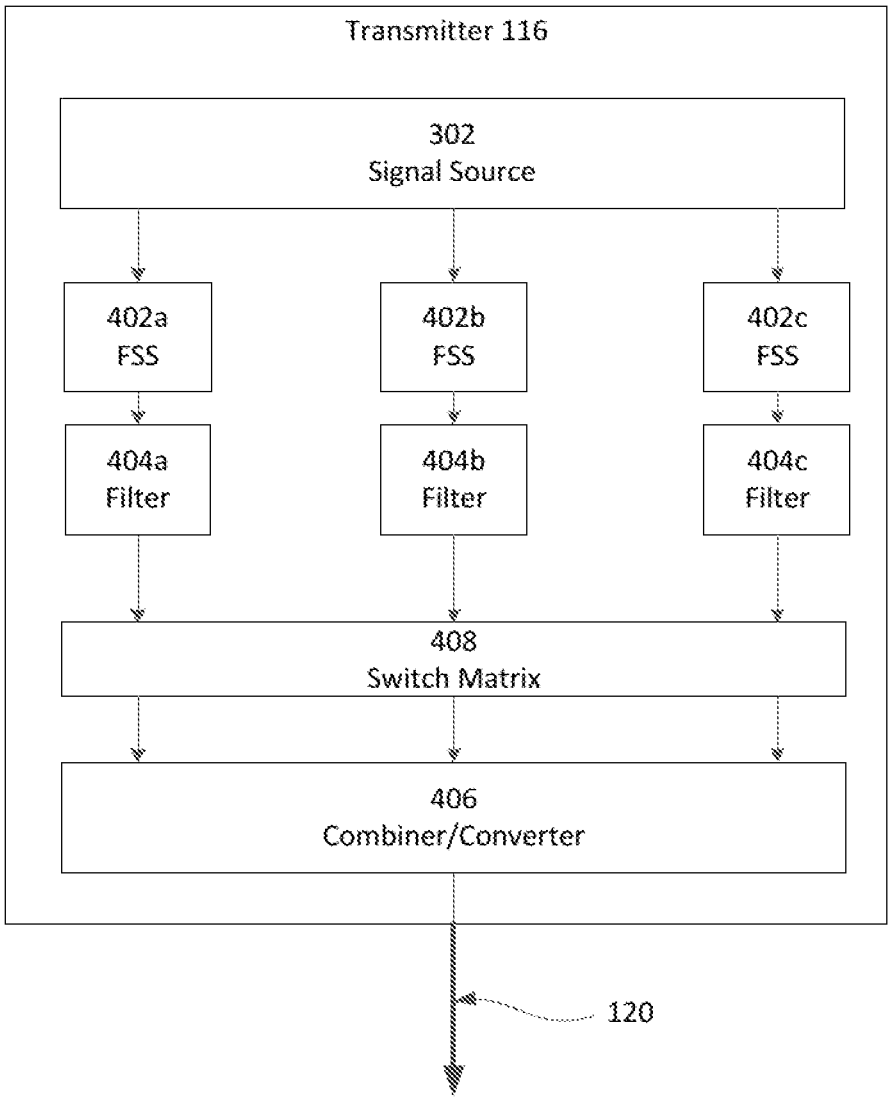
FIG. 4 is a block diagram showing an example of a transmitter for use with the opto-electrical network of FIG. 3 for controlling downhole electronic devices according to one example.

FIG. 4 is a block diagram showing an example of a transmitter 116 for use with the opto-electrical network of FIG. 3 for controlling downhole electronic devices according to one example. The transmitter 116 can include a signal source 302. The signal source 302 can generate electrical signals with frequencies associated with one or more electronic devices operable by the receiver. In this manner the transmitter 116 can operate all, or fewer than all, of the electronic devices.

The signal source 302 can be coupled to frequency selector switches 402*a*, 402*b*, 402*c* (abbreviated "FSS" in FIG. 4). The frequency selector switches 402*a*, 402*b*, 402*c* can prevent (or allow) a signal with a certain frequency from passing (e.g., and being transmitted through the remainder of the transmitter circuit). For example, the frequency selector switch 402*a* can be actuated to allow or deny a signal with a frequency of 1 GHz from passing. A user can actuate one of the frequency selector switches 402*a*, 402*b*, 402*c* to, for example, prevent a signal within a frequency band associated with an electronic device from being transmitted, and thereby operating the electronic device. In some aspects, the transmitter 116 may not include the frequency selector switches 402*a*, 402*b*, 402*c*. Although each of the frequency selector switches 402*a*, 402*b*, 402*c* is depicted as a separate component, the frequency selector switches 402*a*, 402*b*, 402*c* can be integrated into a single component (e.g., with one or more control lines for actuating each of the frequency selector switches 402*a*, 402*b*, 402*c*).

The transmitter 116 can also include filters 404*a*, 404*b*, 404*c*. Each of the filters 404*a*, 404*b*, 404*c* can be electrically coupled to a corresponding one of the frequency selector switches 402*a*, 402*b*, 402*c*. Examples of the filters 404*a*, 404*b*, 404*c* can include a band-pass, band-stop, high-pass, or low-pass filter. The filters 404*a*, 404*b*, 404*c* can prevent noise or parasitic frequency signals from being communicated to the receiver. For example, the filter 404*a* can be a band-pass filter that allows a frequency range from 900 MHz to 1.1 GHz to pass. This can prevent signal outside the range from 900 MHz to 1.1 GHz from distorting or otherwise interfering with a control signal output by the signal generate 302, for example, at 1 GHz. In some aspects, the transmitter 116 may not include one or more of the filters 404*a*, 404*b*, 404*c*. Although each of the filters 404*a*, 404*b*, 404*c* is depicted as a separate component, the filters 404*a*, 404*b*, 404*c* can be integrated into a single component (e.g., with one or more control lines for actuating each of the filters 404*a*, 404*b*, 404*c*). For example, the filters 404*a*, 404*b*, 404*c* can be integrated into the combiner/converter 406.

The transmitter 116 can also include a combiner/converter 406. The combiner/converter 406 can be electrically coupled to the filters 404*a*, 404*b*, 404*c*. The combiner/converter 406 can combine electrical signals, for example from one or more filters 404*a*, 404*b*, 404*c*, into a single electrical signal. The combiner/converter 406 can further convert the single electrical signal into an optical signal for transmission over the optical cable 120. The combiner/converter 406 can be, or can include, an E/O converter (e.g., the E/O converter 304 described with respect to FIG. 3).

Figure 5:
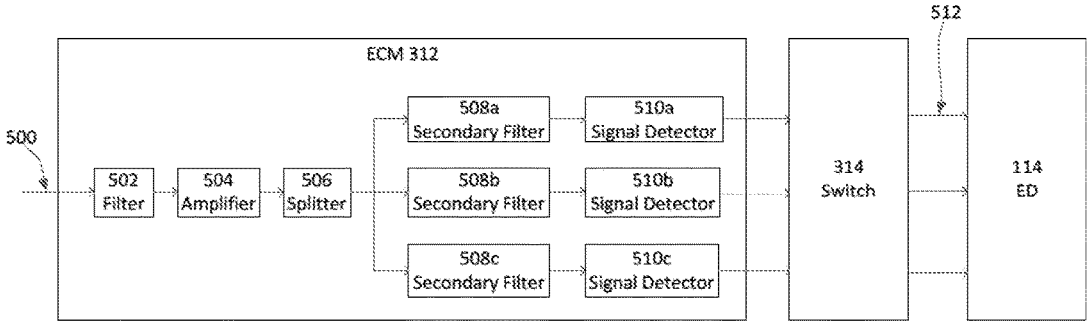
FIG. 5 is a block diagram showing an example of an electronic control module for use with the opto-electrical network of FIG. 3 for controlling downhole electronic devices according to one example.

FIG. 5 is a block diagram showing an example of an electronic control module 312 for use with the opto-electrical network 300 for controlling downhole electronic devices 114*a* according to one example. The electronic control module 312 can receive an electrical signal via input 500. For example, the electronic control module 312 can receive an electrical signal from the O/E converter 310*a* depicted in FIG. 3.

The electronic control module 312 can include a filter 502. The electrical signal can be transmitted to the filter 502. Examples of the filter 502 can include a band-pass filter, a band-stop filter, a low-pass filter, and a high-pass filter. The filter 502 can receive the signal and allow one or more frequencies associated with a specific electronic device 114*a* to pass. The filter 502 can reject one or more frequencies not associated with the specific electronic device 114*a*. If the received signal does not include any frequencies associated with the specific electronic device 114*a*, the received signal may be blocked and not pass further through the electronic control module 312.

The electronic control module 312 can include an amplifier 504. The amplifier 504 can receive a filtered version of the electrical signal from the filter 502. The amplifier 504 can amplify the signal. The amplifier 504 can include a low noise amplifier, an operational amplifier, a transistor, or a tube. The amplifier 504 can be configured to improve the signal-noise-ratio of the signal.

The electronic control module 312 can include a splitter 506. The amplifier 504 can transmit the amplified signal to the splitter 506. The splitter 506 can receive and split the signal between two or more secondary filters 508*a*, 508*b*, 508*c*. The secondary filters 508*a*, 508*b*, 508*c* can receive the split signal and further separate the signal into unique channels for identifying each electronic device 114. Examples of the secondary filters 508*a*, 508*b*, 508*c* can be band-pass, low-pass, or high-pass filters. The secondary filters 508*a*, 508*b*, 508*c* can receive the signal and allow one or more frequencies within a bandwidth to pass. For high frequencies, the quality factor (Q) of each of the secondary filters 508*a*, 508*b*, 508*c* can be high. For example, secondary filter 508*a* can allow frequencies between 910 MHz and 1 GHz to pass. Secondary filter 508*b* can allow frequencies between 1 GHz and 1.5 GHz to pass, and secondary filter 508*c* can allow frequencies between 1.5 GHz and 1.9 GHz to pass. Each frequency band can be associated with a different instruction for operating an associated electronic device 114*a*.

The electronic control module 312 can include signal detectors 510*a*, 510*b*, 510*c*. The signal detectors 510*a*, 510*b*, 510*c* can detect whether a signal has passed through an associated one of the secondary filters 508*a*, 508*b*, 508*c*. In some aspects, the signal detectors 510*a*, 510*b*, 510*c* can include diodes, comparators, resistors, capacitors, rectifiers, or transistors. One example of a signal detector is further described with respect to FIG. 6.

If no signal or a weak signal has passed through the associated one of the secondary filters 508*a*, 508*b*, 508*c* (e.g., the signal was filtered out), the corresponding one of the signal detectors 510*a*, 510*b*, 510*c* may not detect a signal. If the corresponding one of the signal detectors 510*a*, 510*b*, 510*c* does not detect a signal, it may not cause the associated electronic device 114*a* to perform a function associated with the signal (e.g., may not turn on or off the electronic device 114, or may not cause the electronic device 114 to detect a pressure, temperature, or other well system characteristic). If the corresponding one of the signal detectors 510*a*, 510*b*, 510*c* detects the presence of a signal (e.g., if the signal passed through the associated one of the secondary filters 508*a*, 508*b*, 508*c*), the corresponding one of the signal detectors 510*a*, 510*b*, 510*c* can transmit one or more control signals to a switching circuit 314. Based on the control signals, the switching circuit 314 can operate one or more control lines 512 to cause the corresponding electronic device 114 to perform a function associated with the signal.

Figure 6:
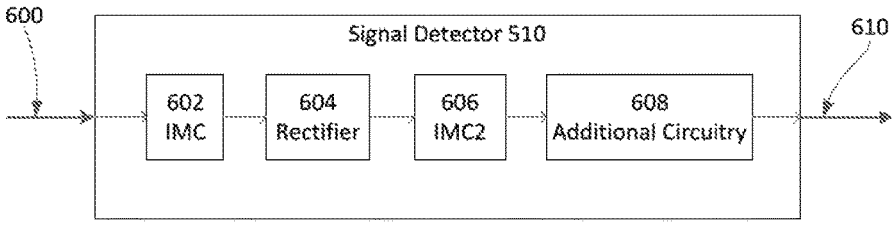
FIG. 6 is a block diagram showing an example of a signal detector for use with the electronic control module of FIG. 5 for controlling downhole electronic devices according to one example.

FIG. 6 is a block diagram showing an example of a signal detector 510 for use with the electronic control module 312 for controlling downhole electronic devices according to one example. The signal detector 510 can receive an electrical signal at an input 600. For example, the signal detector 510 can receive an electrical signal from the secondary filter 508*a* described above with respect to FIG. 5.

The signal detector 510 can include an impedance matching circuit 602 (abbreviated "IMC" in FIG. 6). The impedance matching circuit 602 can include one or more capacitors, inductors, and resistors. In some aspects, the impedance matching circuit 602 can include a transformer, a resistive network, a stepped transmission line, a filter, an L-section, etc. The impedance matching circuit 602 can maximize power transfer of the electrical signal to the rectifier 604.

The rectifier 604 can receive the electrical signal and convert the signal, which can be an analog signal, to a direct current (DC) signal. The rectifier 604 can include active or passive circuitry. For example, the rectifier 604 can include a diode. In some aspects, including only passive circuitry in the rectifier 604 can allow the signal detector 510 to consume minimal amounts of power. The rectifier 604 can be electrically coupled to a power supply (and a resistor) for DC biasing. In some aspects, the rectifier 604 can include an envelope filter for amplitude demodulation. In other aspects, the rectifier 604 can be configured to perform phase or frequency demodulation.

The signal detector 510 can also include a second impedance matching circuit 606 (abbreviated "IMC2" in FIG. 6). The second impedance matching circuit 606 can maximize power transfer between the rectifier 604 and a load. For example, the second impedance matching circuit 606 can maximize power transfer between the rectifier 604 and the additional circuitry 608.

The signal detector 510 can also include additional circuitry 608. The additional circuitry 608 can receive an electrical signal from the second impedance matching circuit 606. The additional circuitry 608 can be configured to further process the signal. In one example, the additional circuitry 608 can include a capacitor in parallel with a resistor. In some aspects, the additional circuitry 608 can be configured for integrating, differentiating, filtering, or wave-shaping the signal.

The signal detector 510 can output the resulting signal via output 610. For example, the signal detector 510 can output the resulting signal to switching circuit 314 shown in FIG. 5. In some aspects, the signal detector 510 may not include the impedance matching circuit 602, the second impedance matching circuit 606, or the additional circuitry 608.

Figure 7:
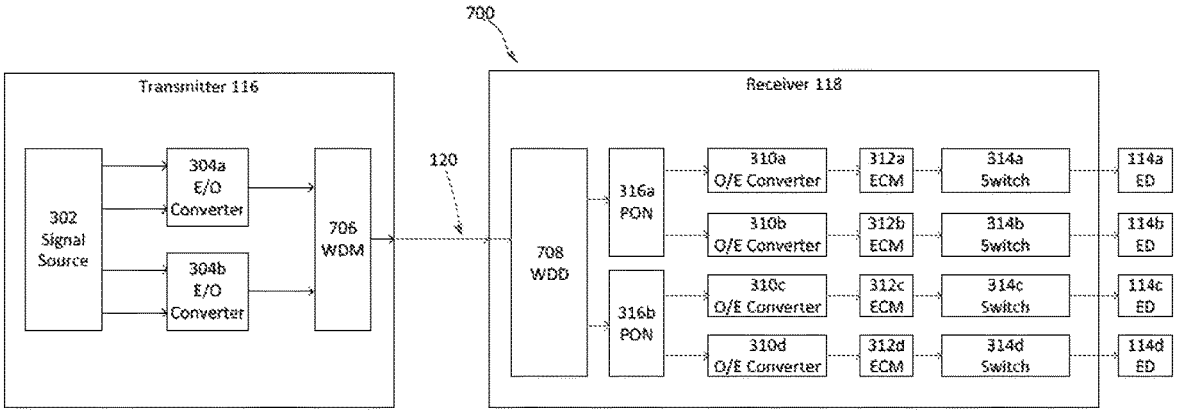
FIG. 7 is a block diagram showing an example of an opto-electrical network using optical wavelength multiplexing for controlling downhole electronic devices according to one example.

FIG. 7 is a block diagram showing an example of an opto-electrical network 700 using optical wavelength multiplexing for controlling downhole electronic devices 114*a*, 114*b*, 114*c*, 114*d* according to one example. In this example, the transmitter 116 includes a signal source 302. The signal source 302 can include or be electrically coupled to a computing device (not shown). The computing device can include a processor. The processor can be interfaced with other hardware via a bus. A memory, which can include any suitable tangible (and non-transitory) computer-readable medium, such as RAM, ROM, EEPROM, or the like, can embody program components that configure operation of the computing device. In some aspects, the computing device can include input/output interface components (e.g., a display, keyboard, touch-sensitive surface, and mouse) and additional storage.

The signal source 302 can transmit a signal with a frequency associated with a specific one of the electronic devices 114*a*, 114*b*, 114*c*, 114*d* to a corresponding one of the E/O converters 304*a*, 304*b*. For example, the signal source 302 can transmit signals with frequencies between $f_1$ and $f_k$ to E/O converter 304*a*. The signal source 302 can transmit signals with frequencies between $f_{k+1}$ and $f_n$ to E/O converter 304*b*. The E/O converter 304*a*, 304*b* can convert the signal to an optical signal with a specific wavelength ($\lambda$). For example, the E/O converter 304*a* can convert sensor signals with frequencies between $f_1$ and $f_k$ to optical signals with wavelength $\lambda_{01}$. The E/O converter 304*b* can convert sensor signals with frequencies between $f_{k+1}$ and $f_n$ to optical signals with wavelength $\lambda_{02}$.

The E/O converters 304*a*, 304*b* can transmit optical signals to a wavelength division multiplexer (WDM) 706. The WDM 706 can receive the optical signal and multiplex the signal based on optical signal wavelengths. For example, the WDM 706 can multiplex an optical signal with wavelength $\lambda_{01}$ with an optical signal with wavelength $\lambda_{02}$. The transmitter 116 can transmit the wavelength modulated signal over the optical cable 120 to the receiver 118.

The receiver 118 can receive the wavelength-modulated signal at a wavelength division demultiplexer (WDD) 708. The WDD 708 can demultiplex the wavelength modulated signal into two or more wavelengths. These demultiplexed signals can be transmitted to passive optical networks 316*a*, 316*b*. The passive optical networks 316*a*, 316*b* can split the demultiplexed signals and transmit the split signals to O/E converters 310*a*, 310*b*, 310*c*, 310*d*. The rest of the receiver 118 circuit components (e.g., the electronic control modules 312*a*, 312*b*, 312*c*, 312*d* and switching circuits 314*a*, 314*b*, 314*c*, 314*d*) can be configured to function as described with respect to FIG. 3. The receiver 118 can use the demultiplexed signals to operate the electronic devices 114*a*, 114*b*, 114*c*, 114*d*.

In some aspects, wavelength division multiplexing can allow the opto-electrical network 700 to work with a larger number of electronic devices 114*a*, 114*b*, 114*c*, 114*d*. Each one of the electronic devices 114*a*, 114*b*, 114*c*, 114*d* can be assigned a frequency band associated with a particular optical wavelength band (which can include a single optical wavelength). Because the opto-electrical network 700 can multiplex Z different optical wavelengths and modulate N frequencies for each individual optical wavelength, the opto-electrical network 700 can achieve a higher number of unique identifiers ($Z^N$) for individually controlling a higher number of electronic devices 114*a*, 114*b*, 114*c*, 114*d*.

Figure 8:
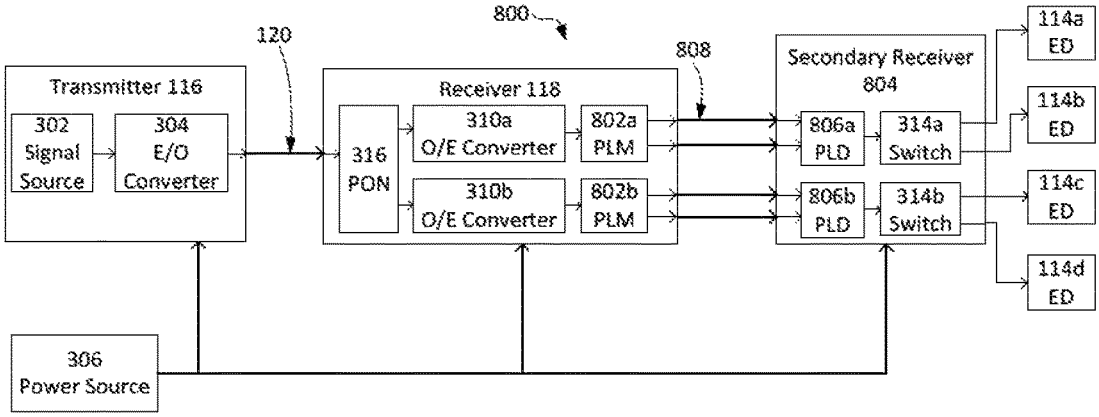
FIG. 8 is a block diagram showing an example of an opto-electrical network that can use a digital signal for controlling downhole electronic devices according to one example.

FIG. 8 is a block diagram showing an example of an opto-electrical network 800 that can use a digital signal for controlling downhole electronic devices 114*a*, 114*b*, 114*c*, 114*d* according to one example. The opto-electrical network 800 can include a transmitter 116. The transmitter 116 can include a signal source 302 configured to generate a digital signal. The signal source 302 can include a computing device, processor, or microcontroller. The digital signal can identify a particular one of the electronic devices 114*a*, 114*b*, 114*c*, 114*d* to be controlled, and include one or more instructions for causing the one of the electronic devices 114*a*, 114*b*, 114*c*, 114*d* to perform one or more functions. For example, the digital signal can identify an electronic device 114*a* using a series of bits, and can include an instruction to turn on or off the electronic device 114*a* using an additional series of bits.

The signal source 302 can transmit the digital signal to an E/O converter 304, which can convert the digital signal into a digital optical transmission. The digital optical transmission can be transmitted to the receiver 118 via an optical cable 120.

The receiver 118 can receive and split the digital optical transmission (via passive optical network 316) among multiple O/E converters 310*a*, 310*b*. The O/E converters 310*a*, 310*b* can convert the digital optical transmission back into electrical signals. The electrical signals can be transmitted from the O/E converters 310*a*, 310*b* to corresponding power line modulators 802*a*, 802*b* (abbreviated "PLM" in FIG. 8). The power line modulators 802*a*, 802*b* can convert the electrical signals into a digitally modulated signals. In some aspects, the power line modulators 802*a*, 802*b* can include microprocessors, digital-to-analog converters, and one or more analog circuit components (e.g., resistors, capacitors, inductors, diodes, and transistors). The power line modulators 802*a*, 802*b* can transmit the digitally modulated signals over one or more power lines 808 to a secondary receiver 804. The power lines 808 can include copper, gold, or another electrically conductive material. The power lines 808 can also include insulated claddings.

The opto-electrical network 800 can include a secondary receiver 804. In some aspects, the secondary receiver 804 can be positioned in the wellbore. The secondary receiver 804 can include power line demodulators 806*a*, 806*b* (abbreviated "PLD" in FIG. 8). The power line demodulators 806*a*, 806*b* can receive the modulated analog signals from the receiver 118 and convert them into demodulated digital signals. In some aspects, the power line demodulators 806*a*, 806*b* can include analog-to-digital converters, microprocessors, and one or more analog circuit components. The demodulated digital signals can be used to operate switching circuits 314*a*, 314*b*. Based on the demodulated digital signals, the switching circuits 314*a*, 314*b* can cause one of the electronic device 114*a*, 114*b*, 114*c*, 114*d* identifiable from the signal to perform a function associated with the signal. For example, based on information contained within the digital signal, the switching circuit 314*a* may cause electronic device 114*a* to turn on or off.

As described above, the transmitter 116 and receiver 118 can be electrically coupled to a power source 306. In some aspects, the secondary receiver 804 can be electrically coupled to the power source 306. For example, the power line demodulators 806*a*, 806*b* and the switching circuits 314*a*, 314*b* can be coupled to the power source 306.

In some aspects, multiple secondary receivers 804 can be coupled to a single receiver 118. For example, three secondary receivers 804 can be coupled to a receiver 118 via power lines 808. The spacing between the secondary receivers 804 can be uniform or non-uniform. The transmitter 116 can transmit optical signals to the receiver 118, which can transmit electrical signals over the power lines 808 to the secondary receivers 804. The secondary receivers 804 can receive the electrical signals and control one or more associated electronic devices 114*a*, 114*b*, 114*c*, 114*d*.

Figure 9:
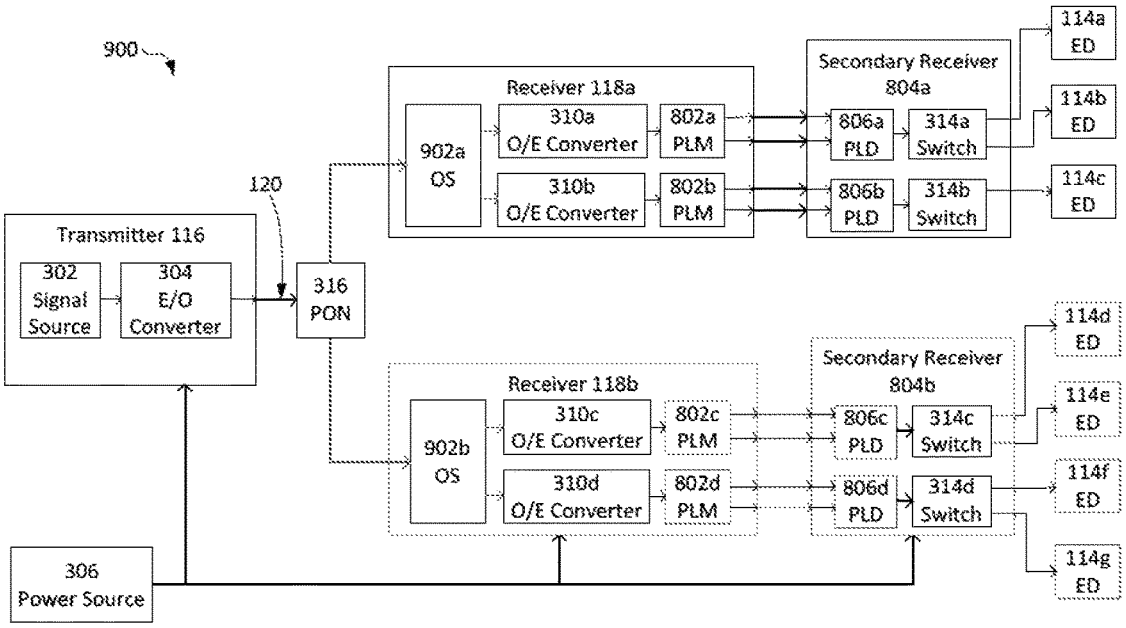
FIG. 9 is a block diagram showing an example of an opto-electrical network that can use a digital signal and optical time modulation for controlling downhole electronic devices according to one example.

FIG. 9 is a block diagram showing an example of an opto-electrical network 900 that can use a digital signal and optical time modulation for controlling downhole electronic devices 114*a*, 114*b*, 114*c*, 114*d* according to one example. The opto-electrical network 900 can include a signal source 302. A described above, the signal source 302 can include a computing device, processor, or microcontroller. The signal source 302 can generate a time-modulated digital signal. The signal source 302 can transmit the time-modulated digital signal to an E/O converter 304, which can convert the time-modulated digital signal into a time-modulated optical signal. The time-modulated optical signal can be transmitted to one or more receivers 118*a*, 118*b* via a passive optical network 316. The passive optical network 316 can split the time-modulated optical signal and transmit the split signals to one or more receivers 118*a*, 118*b*.

The receivers 118*a*, 118*b* can respectively include optical switches 902*a*, 902*b* (abbreviated "OS" in FIG. 9). In some aspects, each of the optical switches 902*a*, 902*b* can be electrically coupled to a processor, microcontroller, or computing device (not shown) operable for controlling the particular one of the optical switches 902*a*, 902*b*. The optical switches 902*a*, 902*b* can include a Micro-Electro-Mechanical system (MEMS). The optical switches 902*a*, 902*b* can receive time-modulated optical signals and switch the optical signal at different times to different outputs. Based on the switching, the optical switches 902*a*, 902*b* can transmit the optical signals to one of the O/E converters 310*a*, 310*b*. Thereafter, in some aspects, the receivers 118*a*, 118*b* and secondary receivers 804*a*, 804*b* can function as described with respect to FIG. 8.

For illustrative purposes, FIG. 9 depicts the power source 306 as being in electrical communication with to receiver

118*b* and secondary receiver 804*b*. However, other implementations are possible. For example, the power source can be in electrical communication with any number of receivers (e.g., receiver 118*a*) and secondary receivers (e.g., 804*a*).

Figure 10:
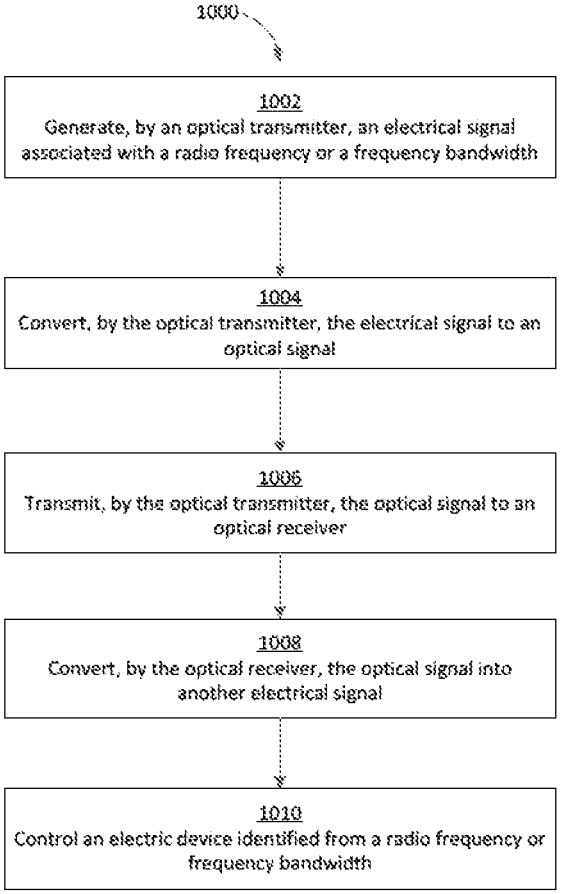
FIG. 10 is a flow chart showing an example of a process for using an opto-electrical network for controlling downhole electronic devices according to one example.

FIG. 10 is flow chart showing an example of a process 1000 for using an opto-electrical network for controlling downhole electronic devices according to one example. For illustrative purposes, the process 1000 is described with reference to components described above with respect to FIG. 3.

The process 1000 can involve an optical transmitter 116 generating an electrical signal associated with a radio frequency or a frequency bandwidth, as depicted in block 1002. A signal source 302 within the transmitter 116 can generate an electrical signal. The electrical signal can be associated with one or more electronic devices 114*a*, 114*b*, 114*c* in a wellbore. For example, the electrical signal can identify one of the electronic devices 114*a*, 114*b*, 114*c* and can include one or more instructions for operating the one of the electronic devices 114*a*, 114*b*, 114*c*.

In some aspects, the electrical signal can be a tone having a radio frequency or frequency bandwidth. One or more of the electronic devices 114*a*, 114*b*, 114*c* can be controlled based on the frequency or frequency bandwidth of the tone. In some aspects, the frequency or frequency bandwidth of the tone may be used to control an electronic device without modulating the tone or other electrical signal with additional data. For example, the frequency or tone itself can be an identifier for controlling one or more of the electronic devices 114*a*, 114*b*, 114*c*.

The process 1000 can also involve the optical transmitter 116 converting the electrical signal to an optical signal, as depicted in block 1004. An E/O converter 304 coupled to the signal source 302 can convert the electrical signal to the optical signal. In some aspects, the optical transmitter 116 can include a wavelength division multiplexer. The wavelength division multiplexer can generate the optical signal from a multitude of optical signals.

The process 1000 can also involve the optical transmitter 116 transmitting the optical signal to an optical receiver 118, as depicted in block 1006. For example, the E/O converter 302 can transmit the optical signal over an optical cable 120 (e.g., a fiber optic cable) to the optical receiver 118. The optical receiver 118 can be positioned in a wellbore.

The process 1000 can also involve the optical receiver 118 converting the optical signal into another electrical signal, as depicted in block 1008. The electrical signal can be associated with the radio frequency or the frequency bandwidth. For example, the optical receiver 118 can receive the optical signal and can transmit the received optical signal to one or more O/E converters 310*a*, 310*b*, 310*c*. The O/E converters 310*a*, 310*b*, 310*c* can convert the optical signal into an electrical signal.

In some aspects, a wavelength division demultiplexer coupled between the optical cable 120 and the one or more O/E converters 310*a*, 310*b*, 310*c* of the optical receiver 118. The wavelength division demultiplexer can split the optical signal into a multitude of optical signals. The O/E converters 310*a*, 310*b*, 310*c* can convert the multitude of optical signals into electrical signals.

In some aspects, the optical receiver 118 can transmit the electrical signal to an actuator (e.g., switch 310) for operating one or more electronic devices 114*a*, 114*b*, 114*c*. For example, the optical receiver 118 can filter and amplify the electrical signal. The optical receiver 118 to transmit the filtered and amplified electrical signal to a signal detector. The signal detector can operate the actuator in response to detecting the filtered and amplified electrical signal.

The process 1000 can also involve the optical receiver 118 controlling one of the electronic device 114*a*, 114*b*, 114*c*, as depicted in block 1010. The optical receiver 118 can control an electronic device identified from the radio frequency or the frequency bandwidth. For example, the optical receiver 118 can apply power to one or more control lines coupled to a switch 314 in a configuration operable to control the electronic device. In some aspects, based on the power supplied to the control lines coupled to the switch 314, the switch 314 can turn on or off the identified one of the electronic devices 114*a*, 114*b*, 114*c*, or can cause the identified one of the electronic devices 114*a*, 114*b*, 114*c* to perform one or more functions.

Figure 11:
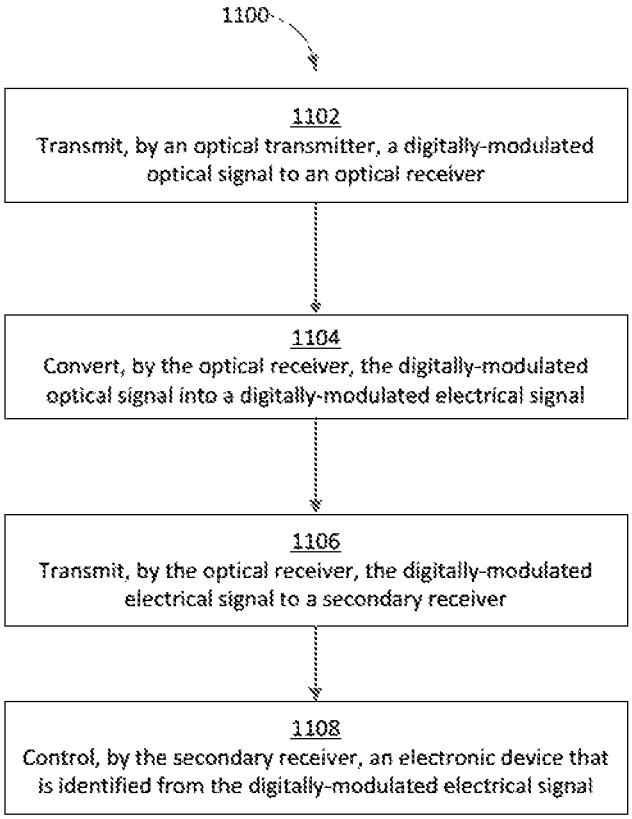
FIG. 11 is a flow chart showing another example of a process for using an opto-electrical network for controlling downhole electronic devices according to one example.

FIG. 11 is flow chart showing an example of a process 1100 for using an opto-electrical network for controlling downhole electronic devices according to one example. For illustrative purposes, the process 1100 is described with reference to components described above with respect to FIG. 8.

The process 1000 can involve an optical transmitter 116 transmitting a digitally-modulated optical signal to an optical receiver 118, as depicted in block 1102. The optical receiver 118 can be deployed in a wellbore. The optical transmitter 116 can transmit the digitally-modulated optical signal via an optical cable 120 (e.g., a fiber-optic cable) in the wellbore.

The process 1000 can also involve an optical receiver 118 converting the digitally-modulated optical signal into a digitally-modulated electrical signal, as depicted in block 1104. The digitally-modulated electrical signal can include a digital identifier. In some aspects, one of the power line modulators 802*a*, 802*b* can generate the digitally-modulated electrical signal from an electrical signal generated by one of the O/E converters 310*a*, 310*b*.

The process 1000 can also involve the optical receiver 118 transmitting the digitally-modulated electrical signal to a secondary receiver 804, as depicted in block 1106. For example, the power line modulator 802*a* can transmit the digitally-modulated electrical signal over a power line 808 to the secondary receiver 804.

The process 1000 can also involve the secondary receiver 804 controlling an electronic device that is identified from the digitally-modulated electrical signal, as depicted in block 1108. For example, the secondary receiver 804 can include a power line demodulator 806*a* that can demodulate the digitally-modulated electrical signal. The resulting demodulated electronic signal can include a digital identifier. The secondary receiver 804 can use the digital identifier to control an associated one of the electronic devices 114*a*, 114*b*, 114*c*, 114*d*. For example, based on the digital identifier, the secondary receiver 804 can actuate a switch 314*a* to control the identified one of the electronic devices 114*a*, 114*b*, 114*c*, 114*d*.

In some aspects, an opto-electrical network for controlling downhole devices is provided according to one or more of the following examples:

EXAMPLE #1

A system can include an optical transmitter an optical transmitter operable to generate a first electrical signal associated with a radio frequency or a frequency bandwidth of the radio frequency. The optical transmitter can also be operable to convert the first electrical signal to an optical signal. The optical transmitter can further be operable to transmit the optical signal over a fiber-optic cable to an optical receiver deployed in a wellbore. The system can also include the optical receiver. The optical receiver can be operable to convert the optical signal to a second electrical signal associated with the radio frequency or the frequency bandwidth. The optical receiver can also be operable to control an electronic device in the wellbore that is identified from the radio frequency or the frequency bandwidth of the second electrical signal.

EXAMPLE #2

The system of Example #1 may feature the optical transmitter including a signal source operable to generate the first electrical signal. The signal source can be electrically coupled to an electrical-to-optical converter. The system may also feature the electrical-to-optical converter. The electrical-to-optical converter can be operable to convert the first electrical signal to the optical signal and transmit the optical signal over the fiber-optic cable.

EXAMPLE #3

The system of any of Examples #1-2 may feature the optical receiver including an optical-to-electrical converter. The optical-to-electrical converter can be operable to receive an optical signal. The optical-to-electrical converter can also be operable to convert the optical signal to the second electrical signal. The optical-to-electrical converter can further be operable to transmit the second electrical signal to an actuator. The actuator can be operable to control the electronic device.

EXAMPLE #4

The system of any of Examples #1-3 may feature controlling the electronic device including turning on or off the electric device or causing the electronic device to perform a function.

EXAMPLE #5

The system of any of Examples #1-4 may feature the electronic device being included in multiple electronic devices. The multiple electronic devices can be positioned in a casing of the wellbore.

EXAMPLE #6

The system of any of Examples #1-5 may feature the optical receiver including an electronic control module electrically coupled between an optical-to-electrical converter and the actuator.

EXAMPLE #7

The system of Example #6 may feature the electronic control module including a filtering device operable to filter the second electrical signal and transmit a filtered second electrical signal to an amplifier. The electronic control module may also feature the amplifier. The amplifier can be operable to increase a magnitude of the filtered second electrical signal and transmit a magnified second electrical signal to a signal detector. The electronic control module can further include the signal detector. The signal detector can be operable to operate the actuator in response to detecting the magnified second electrical signal.

EXAMPLE #8

The system of Example #7 may feature the signal detector including a first impedance matching circuit. The signal detector may also feature a passive rectifier electrically coupled to the first impedance matching circuit. The passive rectifier can be operable to convert the magnified second electrical signal to a DC signal. The DC signal can be operable to control the actuator.

EXAMPLE #9

The system of any of Examples #1-8 may feature the optical transmitter including a wave division multiplexer coupled between an electrical-to-optical converter and the fiber-optic cable. The wave division multiplexer can be operable to perform wavelength multiplexing on multiple optical signals to generate the optical signal. The optical receiver can include a wave division demultiplexer coupled between the fiber-optic cable and the optical-to-electrical converter. The wave division demultiplexer can be operable to demultiplex the optical signal to split the optical signal into the multiple of optical signals.

EXAMPLE #10

The system of any of Examples #1-9 may feature the electronic device including multiple antennas.

EXAMPLE #11

A method can include generating, by an optical transmitter, a first electrical signal associated with a radio frequency or a frequency bandwidth of the radio frequency. The method can also include converting, by the optical transmitter, the first electrical signal to an optical signal. The method can further include transmitting, by the optical transmitter, the optical signal to an optical receiver deployed in a wellbore over a fiber-optic cable in the wellbore. The method can also include converting, by the optical receiver, the optical signal into a second electrical signal associated with the radio frequency or the frequency bandwidth. The method can further include controlling an electronic device in the wellbore that is identified from the radio frequency or the frequency bandwidth of the second electrical signal.

EXAMPLE #12

The method of Example #11 may feature generating, by a signal source of the optical transmitter, the first electrical signal. The method may also feature converting, by an electrical-to-optical converter electrically coupled to the signal source, the first electrical signal to the optical signal. The electrical-to-optical converter can transmit the optical signal over the fiber-optic cable.

EXAMPLE #13

The method of any of Examples #11-12 may feature receiving, by an optical-to-electrical converter of the optical receiver, the optical signal. The method may also feature converting, by the optical-to-electrical converter, the optical signal to the second electrical signal. The method may further feature transmitting, by the optical-to-electrical converter, the second electrical signal to an actuator for controlling the electronic device.

EXAMPLE #14

The method of any of Examples #11-13 may feature filtering, by a filtering device, the second electrical signal to generate a filtered second electrical signal. The method may also feature transmitting, by the filtering device, the filtered second electrical signal to an amplifier. The method may further feature increasing, by the amplifier, a magnitude of the filtered second electrical signal to generate a magnified second electrical signal. The method may also feature transmitting, by the amplifier, the magnified second electrical signal to a signal detector. The method may further feature operating, by the signal detector, the actuator in response to detecting the magnified second electrical signal.

EXAMPLE #15

The method of any of Examples #11-14 may feature wavelength division multiplexing, by a wavelength division multiplexer coupled to the optical transmitter, a plurality of optical signals to generate the optical signal. The method may also feature wavelength division demultiplexing, by a wavelength division demultiplexer, the optical signal to split the optical signal into the plurality of optical signals. The wavelength division demultiplexer can be coupled between the fiber-optic cable and the optical-to-electrical converter of the optical receiver.

EXAMPLE #16

The method of any of Examples #11-15 may feature the electronic device being included in a multitude of electronic devices. The multitude of electronic devices can be positioned in a casing of the wellbore. At least one of the multitude of electronic devices can include multiple antennas.

EXAMPLE #17

A method can include transmitting, by an optical transmitter, a digitally-modulated optical signal to an optical receiver deployed in a wellbore over a fiber-optic cable in the wellbore. The method can also include converting, by the optical receiver, the digitally-modulated optical signal into a digitally-modulated electrical signal having a digital identifier. The method can further include transmitting, by the optical receiver, the digitally-modulated electrical signal over a power line to a secondary receiver. The method can also include controlling, by the secondary receiver, an electronic device that is identified using the digital identifier obtained from the digitally-modulated electrical signal.

EXAMPLE #18

The method of Example #17 may feature generating the digitally-modulated electrical signal by a power line modulator of the optical receiver. The method may also feature transmitting, by the power line modulator, the digitally-modulated electrical signal to the secondary receiver via the power line.

EXAMPLE #19

The method of any of Examples #17-18 may feature demodulating, by a power line demodulator of the secondary receiver, the digitally-modulated electrical signal into an electrical signal. The electronic device can be identified using the digital identifier obtained from the electrical signal.

EXAMPLE #20

The method of any of Examples #17-19 may feature controlling the electronic device including actuating a switch. The switch can be coupled between the power line demodulator and the electronic device.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

an optical transmitter and an optical receiver;

wherein the optical transmitter is configured to:

select a particular electronic device to control downhole from among a plurality of electronic devices that are selectively controllable by the optical receiver;

determine a radio frequency band that is assigned to the particular electronic device, each electronic device in the plurality of electronic devices being assigned a specific radio frequency band that is different from the other electronic devices;

select a particular instruction from among a plurality of possible instructions to communicate to the optical receiver, wherein the plurality of possible instructions are for operating the particular electronic device in a plurality of different ways;

determine a particular radio frequency within the radio frequency band that is assigned to the particular instruction, each instruction in the plurality of possible instructions being assigned a specific radio frequency that is different from the other instructions;

generate an electrical signal having the particular radio frequency within the radio frequency band for causing the optical receiver to operate the particular electronic device in accordance with the particular instruction;

convert the electrical signal to an optical signal; and transmit the optical signal over a fiber-optic cable;

wherein the optical receiver is deployable in a wellbore and comprises:

a passive optical network for receiving the optical signal from the fiber-optic cable, splitting the optical signal into at least two optical signals, and communicating each optical signal of the at least two optical signals to a respective optical-to-electrical converter among a plurality of optical-to-electrical converters; and the plurality of optical-to-electrical converters for receiving the at least two optical signals and converting the at least two optical signals into at least two electrical signals having the particular radio frequency; and wherein the optical receiver is operable to (i) select the particular electronic device from among the plurality of electronic devices based on an electrical signal in the at least two electrical signals having a frequency that is within the radio frequency band, and (ii) control the particular electronic device in a specific manner that is designated by the particular instruction based on the frequency being the particular radio frequency.

2. The system of claim 1, wherein the optical transmitter comprises:

a signal source operable to generate the electrical signal, wherein the signal source is electrically coupled to an electrical-to-optical converter; and the electrical-to-optical converter, wherein the electrical-to-optical converter is operable to convert the electrical signal to the optical signal and transmit the optical signal over the fiber-optic cable.

3. The system of claim 2, wherein the optical receiver comprises a switching circuit operable to control the particular electronic device based on the at least two electrical signals from the plurality of optical-to-electrical converters.

4. The system of claim 3, wherein the switching circuit is operable to turn on or off the particular electronic device or cause the particular electronic device to perform a function in response to the at least two electrical signals.

5. The system of claim 1, wherein plurality of electronic devices include at least two of: a well tool, a fluid monitoring tool, a cement monitoring tool, a multi-phase flow monitoring system, a valve, a gauge, or a sensor.

6. The system of claim 1, wherein the optical receiver further comprises at least two electronic control modules electrically coupled between the plurality of optical-to-electrical converters and a switching circuit, each electronic control module of the at least two electronic control modules being coupled between a respective optical-to-electrical converter of the plurality of optical-to-electrical converters and the switching circuit for (i) allowing an electrical signal in a particular frequency range to pass to the switching circuit and (ii) rejecting other electrical signals outside the particular frequency range.

7. The system of claim 6, wherein each electronic control module of the at least two electronic control modules comprises:

a filtering device operable to filter a particular electrical signal in the at least two electrical signals transmitted from a particular optical-to-electrical converter of the plurality of optical-to-electrical converters and transmit a filtered electrical signal to an amplifier;

the amplifier, wherein the amplifier is operable to increase a magnitude of the filtered electrical signal and transmit a magnified electrical signal to a signal detector; and the signal detector, wherein the signal detector is operable operate the switching circuit in response to detecting the magnified electrical signal.

8. The system of claim 7, wherein the signal detector comprises:

an impedance matching circuit; and a passive rectifier electrically coupled to the impedance matching circuit, wherein the passive rectifier is operable to convert the magnified electrical signal to a DC signal, wherein the DC signal is operable to control the switching circuit.

9. The system of claim 1, wherein the optical receiver comprises a wavelength division demultiplexer coupled between the fiber-optic cable and at least one optical-to-electrical converter in the plurality of optical-to-electrical converters, wherein the wavelength division demultiplexer is operable for receiving the optical signal from the fiber-optic cable, splitting the optical signal into a first optical signal having a first optical wavelength and a second optical signal having a second optical wavelength that is different from the first optical wavelength, and transmitting the first optical signal to a first passive optical network and the second optical signal to a second passive optical network that is separate from the first passive optical network.

10. The system of claim 1, wherein the particular electronic device comprises a well tool.

11. A method comprising:

receiving, by an optical receiver, an optical signal over a fiber-optic cable deployable in a wellbore;

splitting, by a passive optical network of the optical receiver, the optical signal into at least two optical signals;

transmitting, by the optical receiver, the at least two optical signals from the passive optical network over separate paths to respective optical-to-electrical converters among a group of optical-to-electrical converters in the optical receiver;

converting, by the group of optical-to-electrical converters, the at least two optical signals into at least two electrical signals;

transmitting, by optical receiver, the at least two electrical signals from the group of optical-to-electrical converters over separate paths to respective electronic control modules that form a group of electronic control modules in the optical receiver;

filtering, by the group of electronic control modules, the at least two electrical signals to (i) enable an electrical signal of the at least two electrical signals to pass through an electronic control module in the group of electronic control modules to a switching circuit based on the electrical signal having a frequency within a particular frequency band, and (ii) prevent another electrical signal among the at least two electrical signals from passing through another electronic control module in the group of electronic control modules based on the other electrical signal having a frequency within the particular frequency band; and controlling, by the switching circuit in the optical receiver, a particular electronic device among a plurality of electronic devices that are coupled to and controllable by the optical receiver in response to receiving the electrical signal having the frequency within the particular frequency band.

12. The method of claim 11, further comprising:

generating, by a signal source of an optical transmitter, a particular electrical signal at the frequency within the particular frequency band for controlling the particular electronic device; and converting, by an electrical-to-optical converter electrically coupled to the signal source, the particular electrical signal into the optical signal, wherein the electrical-to-optical converter transmits the optical signal over the fiber-optic cable.

13. The method of claim 11, wherein the plurality of electronic devices are positioned in a casing of the wellbore, and wherein at least one of the plurality of electronic devices comprises a plurality of antennas.

14. The method of claim 11, wherein at least one electronic control module in the group of electronic control modules:

filters, by a filtering device, a particular electrical signal in the at least two electrical signals transmitted from a particular optical-to-electrical converter of the group of optical-to-electrical converters to generate a filtered electrical signal;

transmits, by the filtering device, the filtered electrical signal to an amplifier of the electronic control module;

increases, by the amplifier, a magnitude of the filtered electrical signal to generate a magnified electrical signal;

transmits, by the amplifier, the magnified electrical signal to a signal detector of the electronic control module;

detects, by the signal detector, the magnified electrical signal; and based on detecting the magnified electrical signal, operates the switching circuit to control the particular electronic device.

15. The method of claim 14, further comprising:

wavelength division demultiplexing, by a wavelength division demultiplexer coupled between the fiber-optic cable and the passive optical network of the optical receiver, the optical signal to split the optical signal into multiple optical signals having different wavelengths;

transmitting, by the optical receiver, a first optical signal of the multiple optical signals to a first passive optical network that includes the passive optical network; and transmitting, by the optical receiver, a second optical signal of the multiple optical signals to a second passive optical network that is different from the first passive optical network.

16. An optical receiver comprising:

an optical network configured to:

receive an optical signal from a fiber-optic cable deployable in a wellbore;

split the optical signal into at least two optical signals; and transmit each optical signal of the at least two optical signals to a respective optical-to-electrical converter; and a plurality of optical-to-electrical converters configured to receive the at least two optical signals and convert the at least two optical signals into at least two electrical signals;

wherein the optical receiver is configured to:

select a particular electronic device from among a plurality of electronic devices based on an electrical signal among the at least two electrical signals having a frequency that is within a radio frequency band corresponding to the particular electronic device; and control the particular electronic device in a specific manner that corresponds to the frequency of the electrical signal.

17. The optical receiver of claim 16, wherein the optical receiver is configured to:

select another electronic device from among the plurality of electronic devices based on another electrical signal among the at least two electrical signals having another frequency that is with another radio-frequency band corresponding to the other electronic device.

18. The optical receiver of claim 17, wherein the optical receiver is configured to:

control the other electronic device in a particular manner that corresponds to the other frequency of the other electrical signal.

19. The optical receiver of claim 16, further comprising a group of electronic control modules configured to:

enable the electrical signal to pass through a first electronic control module in the group of electronic control modules to a switching circuit based on the electrical signal having the frequency within the radio frequency band, the switching circuit being configured to receive the electrical signal and responsively control the particular electronic device; and prevent another electrical signal among the at least two electrical signals from passing through a second electronic control module in the group of electronic control modules based on the other electrical signal having a frequency within the radio frequency band.

20. The optical receiver of claim 16, further comprising a wavelength division demultiplexer configured to:

receive the optical signal from the fiber-optic cable;

split the optical signal into a first optical signal having a first optical wavelength and a second optical signal having a second optical wavelength that is different from the first optical wavelength; and transmit the first optical signal to an optical splitter configured to (i) split the first optical signal into a first optical sub-signal and second optical sub-signal, and (ii) transmit the first optical sub-signal to a first optical-to-electrical converter among the plurality of optical-to-electrical converters and the second optical sub-signal to a second optical-to-electrical converter among the plurality of optical-to-electrical converters.

21. An optical receiver comprising:

a passive optical network configured to:

receive an optical signal from a fiber-optic cable deployable in a wellbore, split the optical signal into at least two optical signals, and transmit the at least two optical signals over separate paths to respective optical-to-electrical converters;

a plurality of optical-to-electrical converters configured to:

receive the at least two optical signals from the passive optical network, convert the at least two optical signals into at least two electrical signals, and transmit the at least two electrical signals over separate paths to respective electronic control modules; and a plurality of electronic control modules configured to:

receive the at least two electrical signals, enable an electrical signal of the at least two electrical signals to pass to a switching circuit based on the electrical signal having a frequency within a particular frequency band, and prevent another electrical signal among the at least two electrical signals from passing to the switching circuit based on the other electrical signal having a frequency within the particular frequency band;

wherein the switching circuit is configured to receive the electrical signal from the plurality of electronic control modules and control a particular electronic device among a plurality of electronic devices based on the electrical signal having the frequency within the particular frequency band.

* * * * *